US005119836A

United States Patent [19]

White

[11] Patent Number: 5,119,836

[45] Date of Patent: Jun. 9, 1992

[54] PREPARATION OF CIGARETTE FILLINGS

[75] Inventor: Victor A. White, Finmere, England

[73] Assignee: GBE International PLC, Andover, England

[21] Appl. No.: 623,978

[22] PCT Filed: Jun. 30, 1989

[86] PCT No.: PCT/GB89/00735

§ 371 Date: Dec. 31, 1990

§ 102(e) Date: Dec. 31, 1990

[87] PCT Pub. No.: WO90/00019

PCT Pub. Date: Jan. 11, 1990

[30] Foreign Application Priority Data

Jun. 30, 1988 [GB] United Kingdom ..... 8815607

[51] Int. Cl.[5] ..... A24B 5/10

[52] U.S. Cl. ..... 131/312; 131/359; 131/369

[58] Field of Search ..... 131/312, 359, 369

[56] References Cited

U.S. PATENT DOCUMENTS 3,429,316 2/1969 Hess ..... 131/359
3,754,934 8/1973 Pitter et al. ..... 131/278
3,867,951 2/1975 Buchmann et al. ..... 131/143
4,694,842 9/1987 Kobayashi ..... 131/359

FOREIGN PATENT DOCUMENTS 2151445 5/1972 Fed. Rep. of Germany .
2138951 5/1972 France .
2255020 12/1974 France .
871952 7/1961 United Kingdom .

*Primary Examiner*—V. Millin
*Assistant Examiner*—Lynne A. Reichard
*Attorney, Agent, or Firm*—Dowell & Dowell

[57] ABSTRACT

A method of preparing a cigarette filling comprising tobacco and a partly fibrous herbal or spice additive, comprising processing the additive to form a sheet material thereof, cutting that sheet material into generally leaf sized portions, blending the cut sheet material with tobacco in the desired ratio of additive to tobacco, and subsequently cutting, drying or otherwise treating the blended material to form a cigarette filling. The invention is particularly but not exclusively concerned with the use of cloves as the additive.

11 Claims, 2 Drawing Sheets

CLOVES (40%)
TOBACCO (60%)
TUMBLE
MOISTEN
NON-FIBROUS COMPONENT
MOISTEN
MILL
OILS
DIGEST
ADDED FIBRE
FIBRILLATION
SHEET
DRY
DICE
BLEND
CUT
DRY
MAKE CIGARETTES

PREPARATION OF CIGARETTE FILLINGS

BACKGROUND OF THE INVENTION

1. Field of the Invention

This invention relates particularly, but not exclusively to the production of so-called Kretek cigarettes comprising tobacco and cloves as an additive, which are smoked predominantly in Indonesia. The invention also finds application in the preparation of cigarette fillings comprising tobacco and any other partly fibrous herbal or spice additive.

2. History of the Related Art

The Kretek cigarette is flavored with the spice clove; the filling typically containing 20% clove but can be up to 40% clove. The remainder of the filling is normal tobacco. The cigarette has the distinctive smell of clove oil and when smoked it produces a crackling sound and the smell of burning incense.

The clove is harvested as a flower bud and is then dried in the sun. It comprises an elongated ovule, four prominent sepals and a small bud of petals and stamens with distinct pollen containing anthers. The ovule and sepals are robust, but the bud is fragile.

The distinctive aromatic and taste qualities of cloves arise from soluble and volatile compounds or oils. The major component is the phenol eugenol which makes up about 90% of the aromatics in the clove. The total aromatic content of the clove which varies with agronometric effects is typically 17% but can rise to around 21%. There are differences in the distribution of aromatic oil within the clove plant. While steam distillation of the flower bud yields about 15% of oil, the stems and leaves only yield about 6% and 2–3% respectively.

The cloves are generally twice the cost of the tobacco, but can cost considerably more in a year with a poor harvest.

As shown in the flow diagram of FIG. 1 of the accompanying drawings, the cloves are, at present, prepared for use in Kretek cigarettes by first soaking in water for several hours and then draining overnight before cutting. The cloves are cut by a type of mill, comprising a horizontal axis rotating drum having serrated teeth on its outside surface and a fixed cutting blade set close to the surface. The cloves are fed to the junction of the blade with the drum and dragged past the cutting blade by the serrated teeth. The cutting action is ragged and degrades the cloves. It generates small particles which when dried are dust and thus are lost from the cutting stage. The cutter capacity is low so that many cutters are required.

The cloves are then dried again in the sun and then blended with already cut tobacco for making into cigarettes. The yield is low as more dust is lost from the drying stage so that as much as 15% in total of the original cloves may be lost as dust containing the desired aromatic parts.

The industry would like to mechanise the drying process as sun drying is interrupted by the weather, and thus stocks of dried material have to be built up and held in store in advance. Attempts to do this have resulted in further degradation of the delicate bud and loss of dust with further reduction in yield. Oils and other aromatics are also lost by evaporation due to the high drying temperatures required by a practical sized drier, considered as alternatives to sun drying. A total of up to 40% of the desirable clove oil (Eugenol) can be lost in such processing. Further such losses accumulate at all process stages. During wetting prior to cutting aromatics are lost by solution. During handling, cutting and drying much of the more fragile material which contains the highest aromatic levels is reduced to a non-usable dust. During drying further aromatics are lost by distillation.

In smoking products, flavor generation depends on the composition of the materials combusted and their temperature and oxygenation during combustion. Hence flavor generation is highly influenced by the size and location within the cigarette of the flavor generators. Over large particles tend to generate less flavor than finely cut strands. At the same time it is known in the cigarette industry that the major flavor contribution is generated by that material which lies within about 0.5 mm of the periphery. Clove material currently incorporated into the cigarette tends to be large and robust which tends to limit its flavor contribution due to its size and location relative to the cigarette periphery.

An object of this invention is a more economical method of producing cigarettes with additives in the tobacco particularly Kretek cigarettes in which the additive is processed in such a manner that the usable additive yield is higher and the additive is used more effectively within the cigarettes so that less of the additive is required to flavor the tobacco.

SUMMARY OF THE INVENTION

According to the present invention there is provided in a method of preparing a cigarette filling comprising tobacco and a partly fibrous herbal or spice additive, comprising processing the additive to form a sheet material thereof, cutting that sheet material into generally leaf sized portions, blending the cut sheet material with tobacco in the desired ratio of additive to tobacco, and subsequently cutting and drying the blended material to form a cigarette filling, the improvement that the processing of the additive includes the step of separating the non-fibrous content of the additive from the fibrous content, the fibrous content being further processed separately to form the sheet material, the non-fibrous content being added back to the sheet material after such further processing characterised in that the processing of the additive includes the step of separating the non-fibrous content of the additive from the fibrous content, the fibrous content being further processed separately to form the sheet material, the non-fibrous content being added back to the sheet material after such further processing.

In this specification and claims, it should be understood that the term "sheet material" as used in the above paragraph is intended to cover sheet, card, board, strip or filaments of material.

Preferably the additive comprises cloves for the production of Kretek cigarettes.

Paper sheet material is manufactured from naturally occurring plant fibers such as linen used in fabrics, but more usually from wood fibres. However, it is well known that a paper-like material can be made from other plant fibers including tobacco. See UK Patent Specification No. 871,952. Such fibers may be obtained by mechanical reduction or chemical digestion, or a suitable combination of both.

Depending on the intended usage of the paper-like material, its content may be high or low and may also contain non-organic dusts such as ground chalk or pigments to give a desired texture or colour. In situations where the fibre content is insufficient to give the finished product the required strength, natural or synthetic gums may also be incorporated.

Paper sheet material products whose strength derives principally from added gums are known as bound sheet. The strength of materials bound with natural gums tends to be low and also moisture sensitive and such materials are unlikely to withstand the processes involved in cigarette manufacture. Those bound with synthetic gums are unsuitable due to taste and their pyrolysis products.

Preferably the fibrous content is so further processed by moistening, milling and mechanical fiberising or digestion, to form a liquid stock from which said sheet material is formed.

Preferably aromatic oils and other aromatic components of the fibrous content are separated out at the mechanical fiberising or digestion stage and added back to the stock as it is formed into said sheet material.

Preferably extra fibrous material is added to said non-fibrous content after the mechanical fiberising or digestion stage.

DESCRIPTION OF PREFERRED EMBODIMENTS

Figure 1:
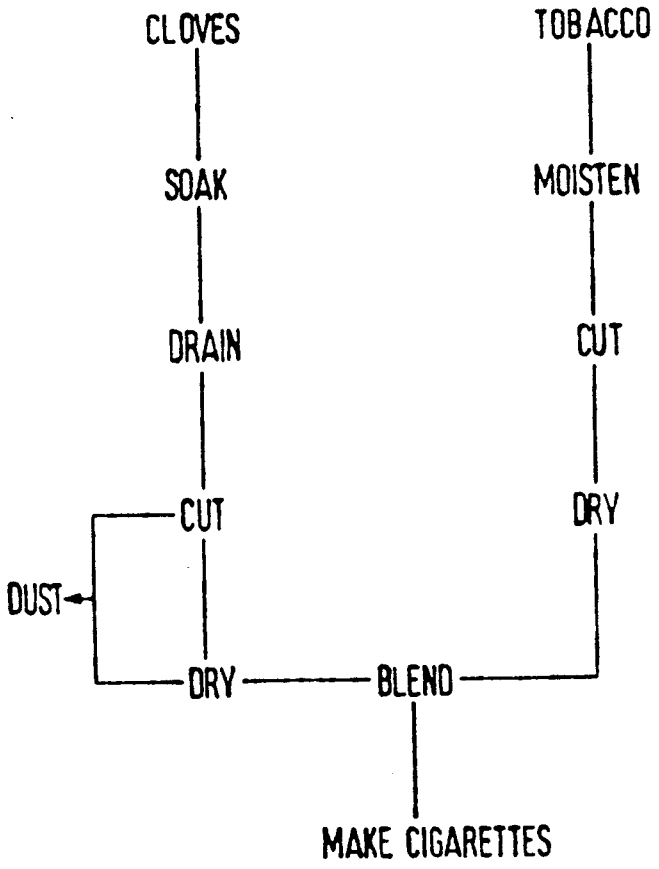
Fig. 1. PRIOR ART
FIG. 1 is a flow diagram of the prior art method of preparing cloves for use in Kretek cigarettes.
Figure 2:
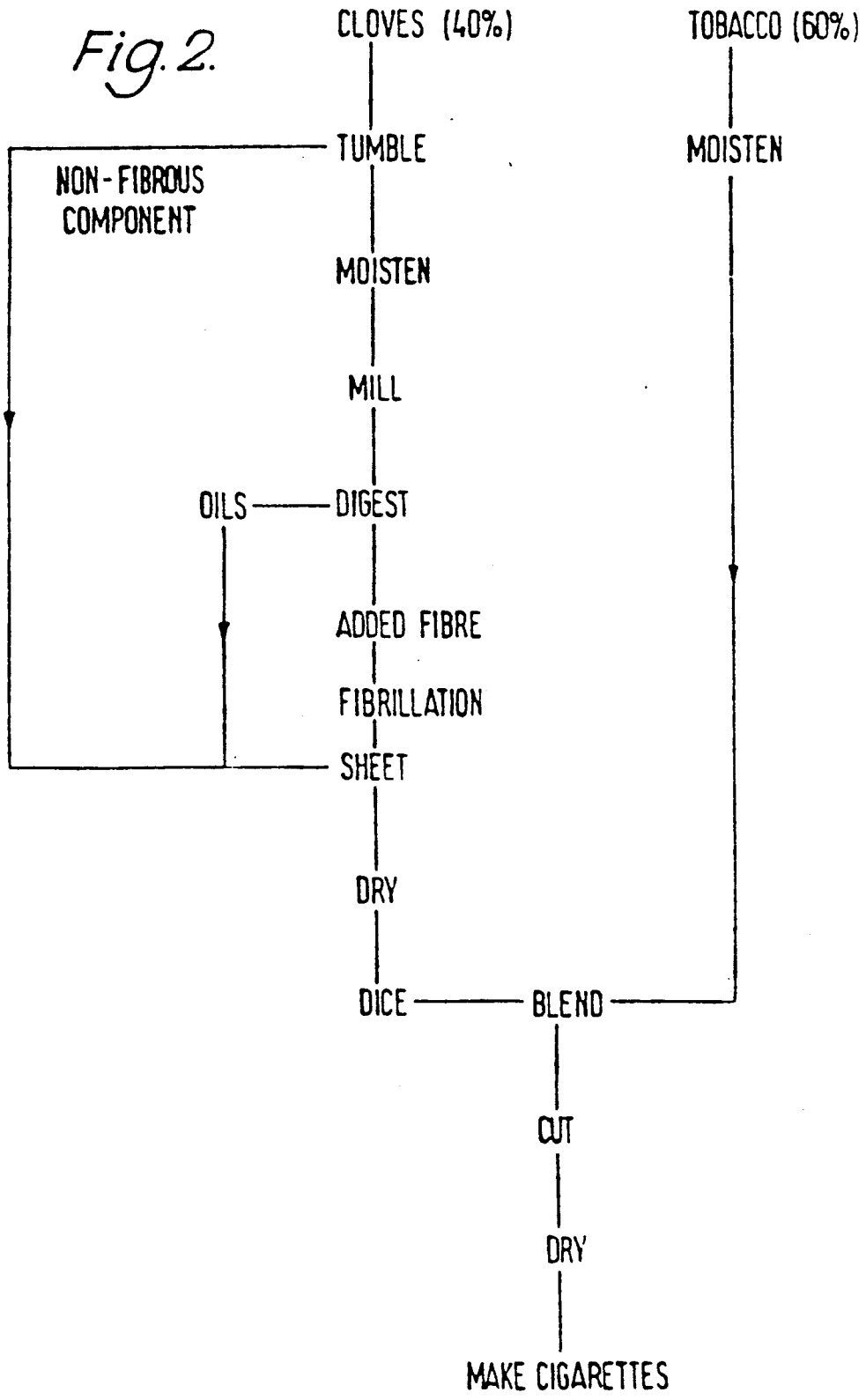
FIG. 2 shows a flow diagram of an example of a method according to the present invention.

In order to promote a fuller understanding of the above and other aspects of the invention, an example of a method embodying the invention will now be described with reference to FIG. 2 of the accompanying drawings which shows a schematic flow diagram of that method.

In this example of the invention the sheet material can be made from whole cloves, from clove constituents derived from whole cloves or components normally lost as waste during clove processing and handling. It can also be made from a mixture of cloves and other plant fiber such as clove stem or tobacco stem to increase the fiber content. Cloves being the terminal bud and not a supporting part of the plant are low in fiber. The addition of tobacco fibre aids the binding and strength of the sheet material.

The cloves (or other additives) are first converted into sheet by techniques substantially as used for paper making and are known per se in that field. The sheet is then reduced to tobacco lamina sized pieces, typically of some 2" (5 cm) square (diced) and added to the tobacco for subsequent cutting and processing in the normal way.

The non-fibrous content of the cloves including the fragile buds are removed first from the dry cloves by tumbling action and are thus not subject to fiberising. The remaining fibrous content is then subjected to the steps of moistening, mechanical fiberising and/or digesting and refining to form a liquid stock for the sheet material. The non-fibrous content is then added to the liquid stock as small intact particles or is first ground to a dust before adding back to the liquid stock.

The aqueous solution separated from the mechanical fiberising or caustic digester is processed to remove undesirable components such as tannins, which are discarded. The desirable oil component in the removed solution is then concentrated and returned to the fibrous content which is converted into the sheet material. Other aromatic compounds lost by normal process solution and distillation are recovered and returned to the liquid stock before it is formed into the sheet material.

Non-fibrous dust or clove particles can alternatively be incorporated into the sheet material after it has been formed from the liquid stock by forming a laminate of two layers of sheet material with a layer of the clove material between them; or by applying them as a surface coating to a single layer of the sheet material. Additional material to enhance the crackling effect when smoked, such as cut particles of whole clove or other material, may be added in any of these manners.

Extra fibrous material, as mentioned above, may be added to the fiber content derived from the cloves, or other additives, as fiber pulp after the mechanical fiberising or digesting stage or as whole fiber before this stage.

The tobacco to which the pieces of sheet material are blended is as taken from conventional bales or casks and pretreated in known manner per se to raise its moisture content. The ratio of blending may be typically 20% cloves, but may be up to 40% cloves with the remainder being tobacco material. These ratios will of course vary for other additives.

In this way the cloves (or other additives) can be more fully utilized than at present and the overall yield improved. By incorporating the fragile highly aromatic parts of the cloves which hitherto have been lost as dusts or by solution or distillation the flavor components of the cloves reaching the cigarette can be increased.

Clove sheet material formed in this matter is thinner and more pliable than the clove fragments currently embodied in the Kretek cigarette. Consequently clove sheet material combusts more readily and is also able to be distributed more evenly than the stem fragments. Hence by combustion effects, and by its position within the cigarette, the use of clove based sheet material increases the generated flavor available when smoked.

I claim:

1. In a method of preparing a cigarette filling comprising tobacco and a partly fibrous herbal or spice additive, comprising the steps of processing the additive to form a sheet material thereof, cutting that sheet material into generally leaf sized portions, blending the cut sheet material with tobacco in the desired ratio of additive to tobacco, and subsequently cutting and drying the blended material to form a cigarette filling, the improvement comprising that in the step of processing of the additive the non-fibrous content of the additive is separated from the fibrous content, the fibrous content thereafter being further processed separately to form the sheet material, the non-fibrous content being added back to the sheet material after such further processing of the fibrous content.

2. A method according to claim 1, in which said additive comprises cloves.

3. A method according to claim 1 or 2, in which said non-fibrous content is separated from the fibrous content by tumbling.

4. A method according to claim 1 in which the fibrous content is so further processed by moistening, milling and mechanical fiberising or digestion, to form a liquid stock from which said sheet material is formed.

5. A method according to claim 4, in which aromatic oils and other aromatic compounds of the fibrous content are separated out at the mechanical fiberising or digestion stage and added back to the stock as it is formed into said sheet material.

6. A method according to claim 4 in which extra fibrous material is added as fiber pulp to said fibrous content after the mechanical fiberising or digestion stage.

7. A method according to claim 4 in which extra fibrous material is added as whole fiber to said fibrous content before the mechanical fiberising or digestion stage.

8. A method according to claim 4 in which the non-fibrous content is added back after the mechanical fiberising or digestion stage.

9. A method according to claim 4 in which said non-fibrous content is added back to the liquid stock from which the sheet material is formed.

10. A method according to claim 1 in which the non-fibrous content is added back to the sheet material by laminating a layer of the non-fibrous content between two layers of the sheet material.

11. A method according to claim 1 in which the non-fibrous content is added back to the sheet material as a coating on at least one side thereof.

* * * * *